US008253312B2

(12) United States Patent
Kameda et al.

(10) Patent No.: US 8,253,312 B2
(45) Date of Patent: Aug. 28, 2012

(54) PLASMA JET SPARK PLUG

(75) Inventors: Hiroyuki Kameda, Aichi-ken (JP); Yoshikuni Sato, Nagoya (JP); Daisuke Nakano, Kiyosu (JP); Naofumi Yamamura, Nagoya (JP); Daisuke Kasahara, Toyoake (JP)

(73) Assignee: NGK Spark Plug Co., Ltd. (JP)

( * ) Notice: Subject to any disclaimer, the term of this patent is extended or adjusted under 35 U.S.C. 154(b) by 0 days.

(21) Appl. No.: 13/040,576

(22) Filed: Mar. 4, 2011

(65) Prior Publication Data

US 2011/0215704 A1 Sep. 8, 2011

(30) Foreign Application Priority Data

Mar. 5, 2010 (JP) ..... P.2010-048808

(51) Int. Cl.
*H01T 13/32* (2006.01)

(52) U.S. Cl. ..... 313/141; 313/142; 123/169 EL

(58) Field of Classification Search ..... None
See application file for complete search history.

(56) References Cited

U.S. PATENT DOCUMENTS

| | | | | |
|---|---|---|---|---|
| 4,388,549 | A * | 6/1983 | Bensman | 313/138 |
| 7,477,008 | B2 | 1/2009 | Artmann et al. | 313/143 |
| 2007/0221156 | A1 | 9/2007 | Hagiwara et al. | 123/143 |
| 2007/0221157 | A1 | 9/2007 | Hagiwara et al. | 123/143 |
| 2010/0102728 | A1 * | 4/2010 | Kato et al. | 315/111.21 |

FOREIGN PATENT DOCUMENTS

| | | |
|---|---|---|
| JP | 2006294257 | 10/2006 |
| JP | 2007507060 | 3/2007 |
| JP | 2007287666 | 11/2007 |
| JP | 2009-228505 | 10/2009 |
| WO | WO2008156035 | 12/2008 |

OTHER PUBLICATIONS

Office Action from corresponding Japanese Patent Application No. 2010-048808, issued on Jan. 10, 2012 (with English translation); 7 pages.

* cited by examiner

*Primary Examiner* — Ashok Patel
(74) *Attorney, Agent, or Firm* — Kusner & Jaffe

(57) ABSTRACT

A plasma jet spark plug for igniting an air-fuel mixture in a conventional combustion device such as an internal combustion engine.

5 Claims, 8 Drawing Sheets

PLASMA JET SPARK PLUG

FIELD OF THE INVENTION

The present invention relates to a plasma jet spark plug for igniting an air-fuel mixture by forming plasma.

BACKGROUND OF THE INVENTION

In a conventional combustion device such as an internal combustion engine, a spark plug for igniting an air-fuel mixture by spark discharge is used. Recently, in order to cope with the demands for higher output and higher fuel efficiency of combustion devices, a plasma jet spark plug was proposed as a spark plug capable of more reliably igniting even a lean air-fuel mixture with fast combustion spreading and an air-fuel ratio higher than ignition limit air-fuel ratio.

Generally, a plasma jet spark plug includes a cylindrical insulator having an axial bore, a central electrode inserted into the axial bore so that the front end surface thereof is inserted further than the front end surface of the insulator, a metal shell disposed at the outer peripheral surface of the insulator, and an annular ground electrode joined to the front end portion of the metal shell. Also, the plasma jet spark plug has a space (a cavity portion) formed by the front end surface of the central electrode and the inner peripheral surface of the axial bore. The cavity portion communicates with the outside through a through hole formed in the ground electrode.

Also, in the above plasma jet spark plug, an air-fuel mixture is ignited as follows. First, a voltage is applied between the central electrode and the ground electrode to cause a spark discharge between them, so that the insulation between the central electrode and the ground electrode is broken. Further, high-energy current flows between the central electrode and the ground electrode to cause the transition to the discharge state so that plasma is generated in the cavity portion. The generated plasma jets through an opening of the cavity portion so that the air-fuel mixture is ignited.

However, in order to realize better ignition quality, it may be conceived that the current flowing in after the spark discharge is set to a higher energy so that greater plasma may be generated. However, if high-energy current flows in, the central electrode is easily consumed, and thus the voltage required for the spark discharge (the voltage demanded) may be rapidly increased.

Thus, there is known a method for forming an inner surface of the cavity portion into a stepped shape to provide a throttle to the cavity portion, so as to realize excellent ignition quality even with relatively low-energy current (for example, see patent document JP-A-2007-287666). Also, there is proposed a technique for designing the cavity portion to have a capacity equal to or smaller than a predetermined value and then setting the cavity portion to have a relatively longer length in the axial direction for the purpose of improved ignition quality (for example, see the patent document JP-A-2006-294257).

However, the insulator located at the spark discharge path is worn thin due to the spark discharge (this phenomenon is referred to as, so-called, channeling). Seeing the technique disclosed in the patent document JP-A-2007-287666, since the inner peripheral surface of the cavity portion is curved (bent), the insulator is easily worn thin at the curved (bent) region. Also, in the spark discharge path, a path passing the worn region of the insulator becomes shorter than other paths, and thus spark discharge is focused in the path, which results in local concentration of the channeling. As a result, the insulator is deeply worn thin in a striped pattern, so that the groove connecting the central electrode and a portion of the ground electrode located at the outer peripheral side may be formed in the inner peripheral surface of the cavity portion. Even though spark discharge and generation of plasma is caused along the groove, the plasma may not be easily jetted out of the cavity portion due to the presence of the ground electrode or the like. In other words, according to the technique disclosed in the patent document JP-A-2007-287666, although excellent ignition quality is realized at an initial stage, the rapid deterioration of ignition quality may accompany use.

Meanwhile, in accordance with the technique disclosed in the patent document JP-A-2006-294257, if the capacity of the cavity portion is set to a predetermined value or below and the axial length of the cavity portion is set to be relatively longer, the inner diameter of the cavity portion is decreased, and further the outer diameter of the front end portion of the central electrode is reduced. For this reason, the heat dissipation of the central electrode is extremely deteriorated, and thus the central electrode may be rapidly consumed. If the central electrode is consumed, the distance between the central electrode and the ground electrode is increased, and thus the demanded voltage is increased. As a result, the time during which the ignition quality can be maintained at the initial stages may be shortened since spark discharge does not occur or the insulator is more easily worn thin by high-voltage spark discharge.

The present invention is made in consideration of the above. An advantage of the invention is a plasma jet spark plug that is capable of preventing local concentration of channeling and maintaining the ignition quality at an initial stage for a long time.

SUMMARY OF THE INVENTION

Hereinafter, each component suitable for accomplishing the above advantage will be described claim by claim. Also, characteristic operation effects of the corresponding component will be described as necessary.

Configuration 1

In accordance with the present invention, there is provided 1. A plasma jet spark plug, comprising:

a cylindrical insulator having an axial bore extending therethrough in an axial direction;

a rod-shaped central electrode inserted into the axial bore so that a front end surface of the central electrode is located further to the rear end side in the axial direction than the front end of the insulator;

a cylindrical metal shell disposed around an outer peripheral surface of the insulator;

a ground electrode installed at a front end portion of the metal shell; and a cavity portion that is a substantially cylindrical space formed by the inner peripheral surface of the axial bore and the front end surface of the central electrode and opened toward a front end side of the plasma jet spark plug, wherein a tapered section having a reduced diameter toward a front end side in the axial direction is formed at a front end portion of the central electrode, and wherein the axial bore includes:

a sidewall section forming the cavity portion; and a diameter-enlarged section extending from a rear end of the sidewall section and formed at a location corresponding to the tapered section of the central electrode in the axial direction, the diameter-enlarged section having an enlarged diameter toward a rear end side in the axial direction along an outer peripheral surface of the tapered section of the central electrode.

In addition, the shape of the cavity portion is not limited to a strictly cylindrical shape, but the inner peripheral surface (the sidewall section) of the axial bore forming the cavity portion may be inclined up to ±5° with respect to an axis line. Also, in regard to a diameter-enlarged section, the expression "along the outer peripheral surface of a tapered section of the central electrode" means that, in a cross-section including the axis line, both external lines are parallel or substantially parallel with each other (for example, an acute angle between external lines of both external lines is 10° or less).

According to the configuration 1, at an initial stage (before the central electrode or the like is not consumed), the cavity portion has a cylindrical shape formed by the sidewall section extending along the axis line with a straight shape and the front end surface of the central electrode. For this reason, local concentration of channeling may be more reliably prevented, compared with the case where the inner peripheral surface of the cavity portion is formed into a stepped shape.

In addition, according to the configuration 1, a tapered section having an enlarged diameter toward the rear end side in the axial direction and disposed at the inner side of the diameter-enlarged section of the insulator is formed at the front end portion of the central electrode, and the front end surface of the central electrode enlarges its diameter slowly as the central electrode is consumed. In other words, the front end surface of the central electrode also enlarges its diameter in conformity with the increase of inner diameter of the cavity portion, accompanied with the consumption of the insulator. Thus, even when the insulator or the central electrode is consumed, the cavity portion may more reliably maintain the cylindrical shape extending along the axis line. As a result, not only at the initial stages but also after the insulator or the central electrode is consumed to some extent, local concentration of channeling may be more reliably prevented.

Also, if the inner diameter of the cavity portion is increased accompanied with the consumption of the insulator, the jetting length of the plasma from the opening of the cavity portion may be decreased, and the ignition quality may be deteriorated. However, if the configuration 1 is applied, the front end portion of the central electrode is consumed together with the consumption of the insulator, and the length of the cavity portion in the axial direction (the cavity length) is increased. Here, if the distance between the central electrode and the ground electrode is increased accompanied with the increase of cavity length, plasma generated between both electrodes is increased, thereby improving the ignition quality. In other words, according to the configuration 1, the deterioration of ignition quality which accompanies an increase of the inner diameter of the cavity portion may be compensated for, so that the ignition quality may be improved due to the increase of the cavity length. Thus, even though the insulator or the like is consumed, the ignition quality may be maintained substantially to the same extent as at the initial stages.

In addition, the ignition quality may be improved by increasing the cavity length, but, if the cavity length is increased too much, the demanded voltage for spark discharge is increased as mentioned above, which may easily cause problems such as a so-called misfire. Thus, though it is required to increase the cavity length for the improvement of ignition quality, the cavity length is desirably increased at a slow rate. In this point, according to the configuration 1, since the rear end side of the tapered section has a relatively large diameter, the heat at the front end portion of the central electrode may be efficiently removed. For this reason, the rate of increase of the cavity length may be set to be relatively slow by forming the front end portion into a tapered shape and configuring the central electrode so that a volume per unit length along the axis line is gradually increased from the front end toward the rear end side. As a result, spark discharge may be performed for a longer time between both electrodes. Also, an increase of the discharge voltage may be suppressed, so that the consumption of the insulator by channeling may be more reliably suppressed.

According to the configuration 1, due to the synergic effects of the aforementioned components, local concentration of channeling may be effectively prevented not only at the initial stages but also when the insulator or the like is consumed, and the ignition quality at the initial stages may be more reliably maintained for a longer time.

Configuration 2

In accordance with another aspect of the present invention, there is provided a plasma jet spark plug as described above wherein, the length (cavity length) L of the cavity portion along the axis line is set to be greater than the inner diameter (cavity diameter) D of the cavity portion. For this reason, the expansion of plasma in the radial direction may be suppressed, and the jetting speed of plasma in the axial direction may be increased. As a result, the jetting length of plasma from the opening of the cavity portion may be increased further, so that the ignition quality may be improved at the initial stages.

In addition, according to the configuration 2, the cavity diameter D is set to be 0.5 mm or more. Thus, under a low-temperature environment just after starting, when the injected fuel gas may be easily liquefied, though the liquefied fuel enters into the cavity portion, the central electrode and the ground electrode are not easily insulated from each other due to the liquefied fuel, since the large cavity diameter D is ensured. In this way, it is possible to improve the starting ability.

Also, since the cavity length L is set to be 1.5 mm or less, the demanded voltage at the initial stages may be lowered extremely. Thus, the cavity length is increased accompanied with the consumption of the central electrode, and, even though the demanded voltage is somewhat increased, the problems such as misfire do not occur as before. As a result, spark discharge may be generated for a longer time in a more reliable way.

In addition, even when $L \geqq D$ is satisfied, if the cavity diameter D exceeds 1.2 mm, plasma may easily spread in the diameter direction, so that the jetting length of the plasma may be shortened. For this reason, in order to improve the ignition quality more reliably, the cavity diameter D is preferably set to be 1.2 mm or less. Also, in order to satisfy $L \geqq D$ while ensuring the cavity diameter D of 0.5 mm or more, the cavity length L is set to be 0.5 mm or more.

Configuration 3

In accordance with another aspect of the present invention, there is provided a plasma jet spark plug as described above wherein, $E \geqq -0.1$, and in the opening of the cavity portion, the region covered by the ground electrode is extremely small. Thus, the jetting of plasma from the cavity portion is not easily disturbed by the ground electrode. Also, the removal of heat of the plasma by the ground electrode may be more reliably prevented, which may promote the growth of plasma. As a result, the ignition quality may be further improved.

In addition, in order to more reliably prevent the jetting of plasma from being disturbed due to the presence of the ground electrode, it may be conceived that a great distance is ensured from the opening of the cavity portion to the through hole of the ground electrode. However, if the distance is too great, when spark discharge is generated, spark discharge is easily generated along the shape of an angled portion between the axial bore and the front end surface of the insulator, so that the angled portion may be intensively worn thin. As a result, the channeling may be locally focused, so that the effect of maintaining the ignition quality at the initial stages for a long time may not be sufficiently realized.

In this point, according to the configuration 3, E≦0.4, and the shortest distance from the opening of the cavity portion to the through hole of the ground electrode is set to be relatively small. Thus, when spark discharge is generated, aerial discharge may be easily generated between the opening of the cavity portion and the ground electrode, so that discharge may be not easily generated along the shape of the angled region between the axial bore and the front end surface of the insulator. As a result, local concentration of channeling may be more reliably prevented due to the effect of suppressing the concentration of channeling, realized by the above configuration, so that the ignition quality at the initial stages may be maintained for a longer time.

Configuration 4

In accordance with still another aspect of the present invention, there is provided a plasma jet spark plug as described above wherein, in the cross-section including the axis line, the acute angle formed between the external line of the tapered section and the straight line orthogonal to the axis line is 30° or above, so that a diameter enlargement rate of the front end surface of the central electrode which accompanies the consumption may be set to be relatively small. In this way, the front end surface of the central electrode may be slowly increased while corresponding to an increase rate of the cavity diameter that slowly increases which accompanies the consumption of the insulator, so that the cavity portion may be maintained in a cylindrical shape more reliably. As a result, the effect of suppressing the concentration of channeling according to the above configuration may be more reliably realized.

Also, in the cross-section including the axis line, the acute angle formed between the external line of the tapered section and the straight orthogonal to the axis line is set to be 75° or less, and the distance between a region (a region where the heat of the tapered section is removed) extending to the rear end side from the rear end of the tapered section of the central electrode and the front end of the tapered section is set to be not excessively increased, or the region extending to the rear end side is set to become not excessively thin. For this reason, the heat at the front end portion of the tapered section may be more reliably removed, so that the abrasion resistance of the central electrode may be improved. As a result, the rate of increase of the cavity length may be set to be more gradual, and further the time during which ignition is possible may be further lengthened.

Configuration 5

In accordance with still another aspect of the present invention, there is provided a plasma jet spark plug as described above wherein, in a state that the central electrode is inserted into the axial bore, the front end portion of the main body is spaced apart from the front end portion of the main body insert portion along the axis line. Thus, when the central electrode is disposed in the axial bore, it is possible to prevent the main body of the central electrode from contacting the axial bore. In this way, though there may be a minor measurement error in the central electrode, it is possible to more reliably prevent the insulator from being damaged.

In addition, the main body may be directly connected to the tapered section of the central electrode or be connected to the tapered section through a region (an intermediate region) connected to the rear end of the tapered section. Thus, for example, a cylindrical intermediate region extending along the axis line may be provided between the rear end of the tapered section and the main body in the central electrode, and the main body may be connected to the rear end of the intermediate region. Also, the intermediate region may be positioned so that the distance between the intermediate region and the ground electrode is great enough to ensure the generation of spark discharge. In this case, after the tapered section disappears due to consumption, a cylindrical cavity portion is formed by the front end surface of the intermediate region and the inner peripheral surface of the axial bore. In other words, after the tapered section disappears, the cavity portion of the spark plug of this configuration substantially has the same shape as a cavity portion of a plasma jet spark plug having a cylindrical cavity portion (for example, JP-A-2007-287665, and the like). Thus, in comparison to the endurance time (the time during which spark discharge is available) in the plasma jet spark plug disclosed in the above patent document, the endurance time may be substantially extended to as much as the time required for disappearance (i.e., consumption) of the tapered section from the beginning of use. Also, after the tapered section of the central electrode is consumed, the ignition quality may be realized to an extent substantially identical to that of the plasma jet spark plug disclosed in the above patent document.

DETAILED DESCRIPTION OF PREFERRED EMBODIMENTS

Figure 1:
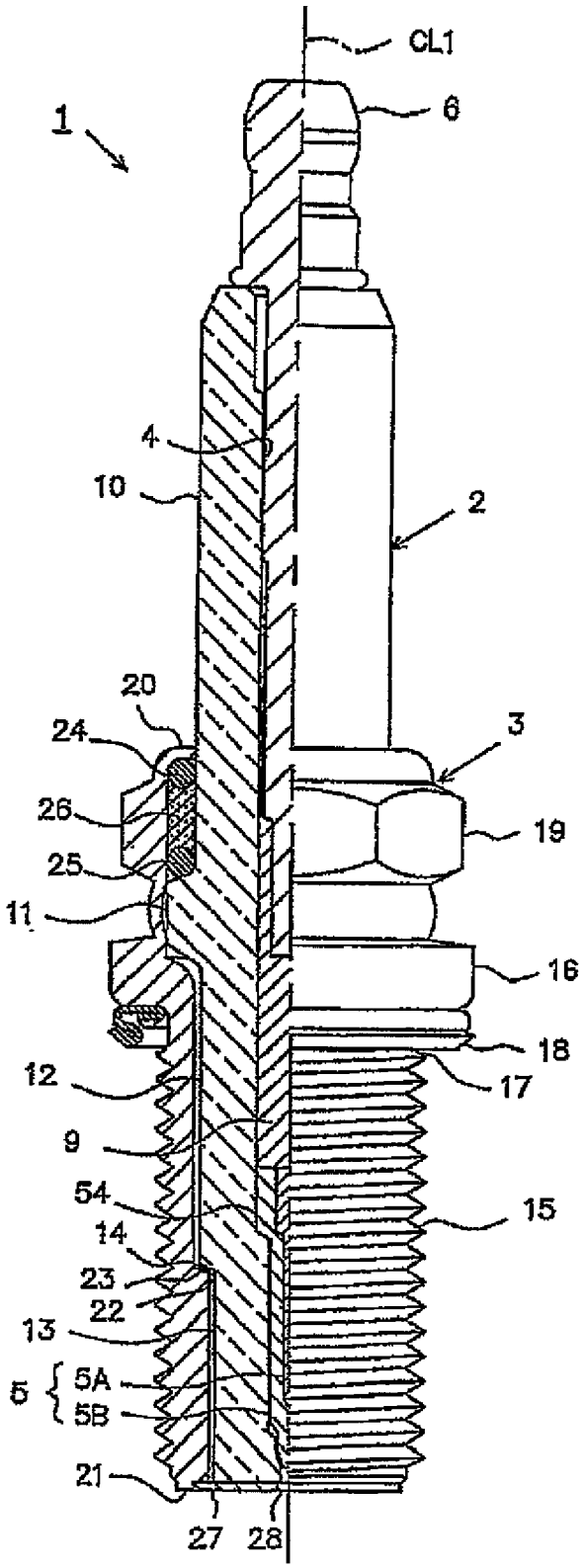
FIG. 1 is a partially-sectioned front view showing a structure of a plasma jet spark plug.
Figure 1A:
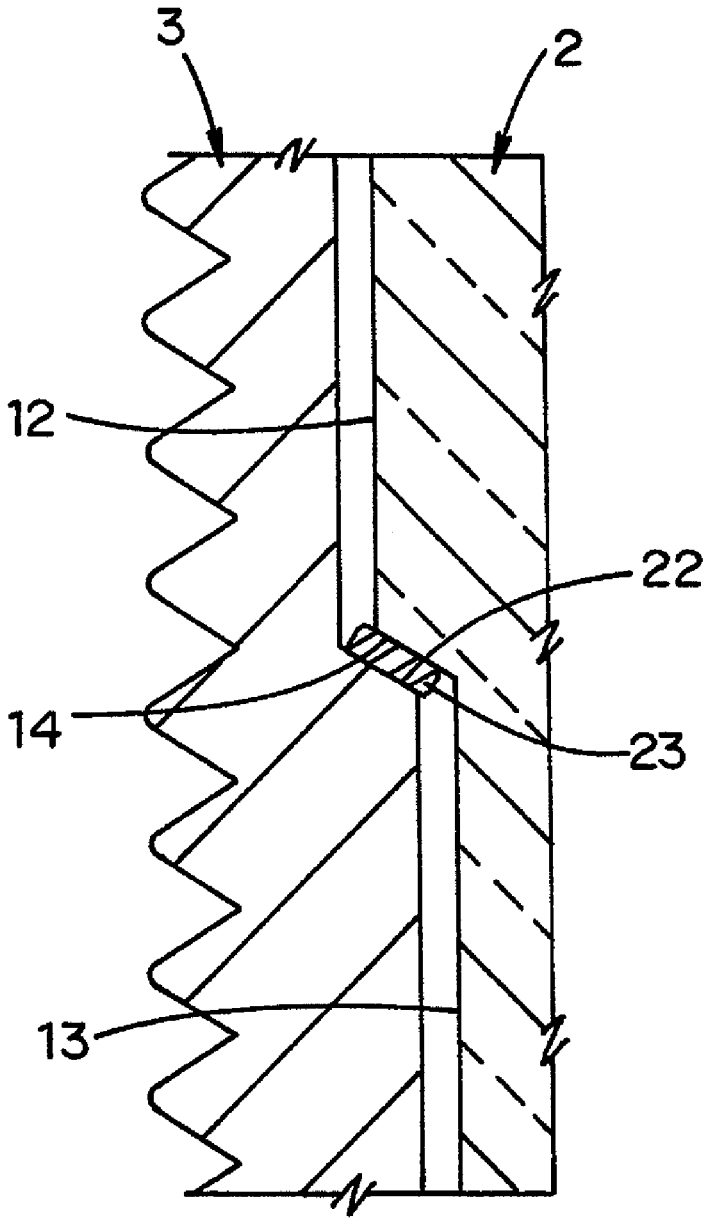
FIG. 1A is an enlarged view showing an annular plate packing disposed between portions of an insulator and a metal shell.

Hereinafter, one embodiment will be described with reference to the drawings. FIG. 1 is a partially-sectioned front view showing a plasma jet spark plug (hereinafter, referred to as a "spark plug") 1. In FIG. 1, the direction of an axis line CL1 of a spark plug 1 is assumed to be the vertical direction, wherein a lower side is a front end side of the spark plug 1 and an upper side is a rear end side of the spark plug 1.

The spark plug 1 includes an insulator 2 that is a cylindrical insulating body, and a cylindrical metal shell 3 supporting the insulator 2.

The insulator 2 is formed by firing alumina or the like as well known in the art. In its appearance, the insulator 2 includes a rear end side chamber 10 formed at a rear end side thereof. A large-diameter region 11 protrudes outwards in a radial direction at a further front end side to the rear end side chamber 10. A middle chamber 12 is formed at a further end side to the large-diameter region 11 and has a smaller diameter than the large-diameter region 11. A long leg region 13 is formed at a further end side to the middle chamber 12 and has a smaller diameter than the middle chamber 12. Also, the large-diameter region 11, the middle chamber 12, and the long leg region 13 of the insulator 2 are received in the metal shell 3. In addition, a tapered end 14 is formed at a contact portion between the middle chamber 12 and the long leg region 13. The insulator 2 is locked to the metal shell 3 at the end 14.

An axial bore 4 is formed through the insulator 2 along the axis line CL1. A central electrode 5 is inserted and fixed at the front end side of the axial bore 4. The central electrode 5 includes a base member having an inner layer 5A made of copper or copper alloy with excellent thermal conductivity and an outer layer 5B made of Ni alloy mainly containing nickel (Ni) (for example, Inconel™ 600 or 610). An electrode tip is joined to the front end of the base member and made of tungsten (W) or W alloy (also, some drawings show the base member and the electrode tip without being distinguished). Further, the central electrode 5 has an overall rod shape (a cylindrical shape). The front end surface of the central electrode 5 is inserted to the rear end side with respect to the front end surface of the insulator 2 (also, the structure of the front end portion of the central electrode 5 will be described later in detail).

A terminal electrode 6 protruding from the rear end of the insulator 2 is inserted and fixed to the rear end side of the axial bore 4.

A cylindrical glass seal layer 9 is installed between the central electrode 5 of the axial bore 4 and the terminal electrode 6. The central electrode 5 is electrically connected to the terminal electrode 6 through the glass seal layer 9.

The metal shell 3 is made of metal such as low carbon steel in a cylindrical shape. A screw portion (a male screw portion) 15 for attaching the spark plug 1 to a mounting hole of a combustion device (for example, an internal combustion engine, a fuel cell reformer, or the like) is formed on the outer peripheral surface of the metal shell 3. A plate-like portion 16 is formed at the outer peripheral surface of the rear end side of the screw portion 15. A ring-shaped gasket 18 is inserted into a screw neck 17 at the rear end of the screw portion 15. A hexagonally-sectioned tool engagement portion 19 for engaging a tool such as a wrench when attaching the metal shell 3 to the combustion device is provided at the rear end side of the metal shell 3. A caulking portion 20 for supporting the insulator 2 is provided at the rear end portion. In addition, an annular engagement portion 21, formed to protrude toward the front end side in the direction of the axis line CL1, is formed at the outer peripheral surface of the front end portion of the metal shell 3. A ground electrode 27, described later, engages with the engagement portion 21.

A tapered end 22 for locking the insulator 2 is provided at the inner peripheral surface of the metal shell 3. The insulator 2 is inserted from the rear end side to the front end side of the metal shell 3, and is fixed by caulking an opening at the rear end side of the metal shell 3 to an inner side in the radial direction, namely by forming the caulking portion 20, in a state that the end 14 of the insulator 2 is locked to the end 22 of the metal shell 3. An annular plate packing 23 is interposed between the ends 14 and 22 of the insulator 2 and the metal shell 3. In this way, the airtightness in the combustion chamber is maintained, and the fuel gas coming into the gap between the long leg region 13 of the insulator 2 and the inner peripheral surface of the metal shell 3 cannot leak out.

Further, in order to ensure more perfect sealing by the caulking, annular ring members 24 and 25 are interposed between the metal shell 3 and the insulator 2 at the rear end side of the metal shell 3, and powder of talc 26 is filled between the ring members 24 and 25. In other words, the metal shell 3 supports the insulator 2 by means of the plate packing 23, the ring members 24 and 25, and the talc 26.

A ground electrode 27 made of Ir alloy mainly containing Ir and having a disk shape (for example, with a thickness of 0.3 mm to 1.0 mm) is joined to the front end portion of the metal shell 3. The ground electrode 27 is joined to the metal shell 3 by welding the outer peripheral surface of the ground electrode 27 to the engagement portion 21 in a state that the ground electrode 27 is engaged with the engagement portion 21 of the metal shell 3. The ground electrode 27 has a through hole 28 formed through the center of the ground electrode 27 in a thickness direction of the plate. The inside of a cavity portion 31, described later, communicates with the outside through the through hole 28. In the embodiment shown, the ground electrode 27 is joined so that the through hole 28 and the axial bore 4 are located on the same axis (in other words, so that the center of the through hole 28 is located on the axis line CL1). Also, the ground electrode 27 is configured so that the ground electrode 27 is in surface-contact with the front end surface of the insulator 2.

The structures of the central electrode 5 and the axial bore 4, which are distinctive components of this embodiment, shall now be described in greater detail.

Figure 2:
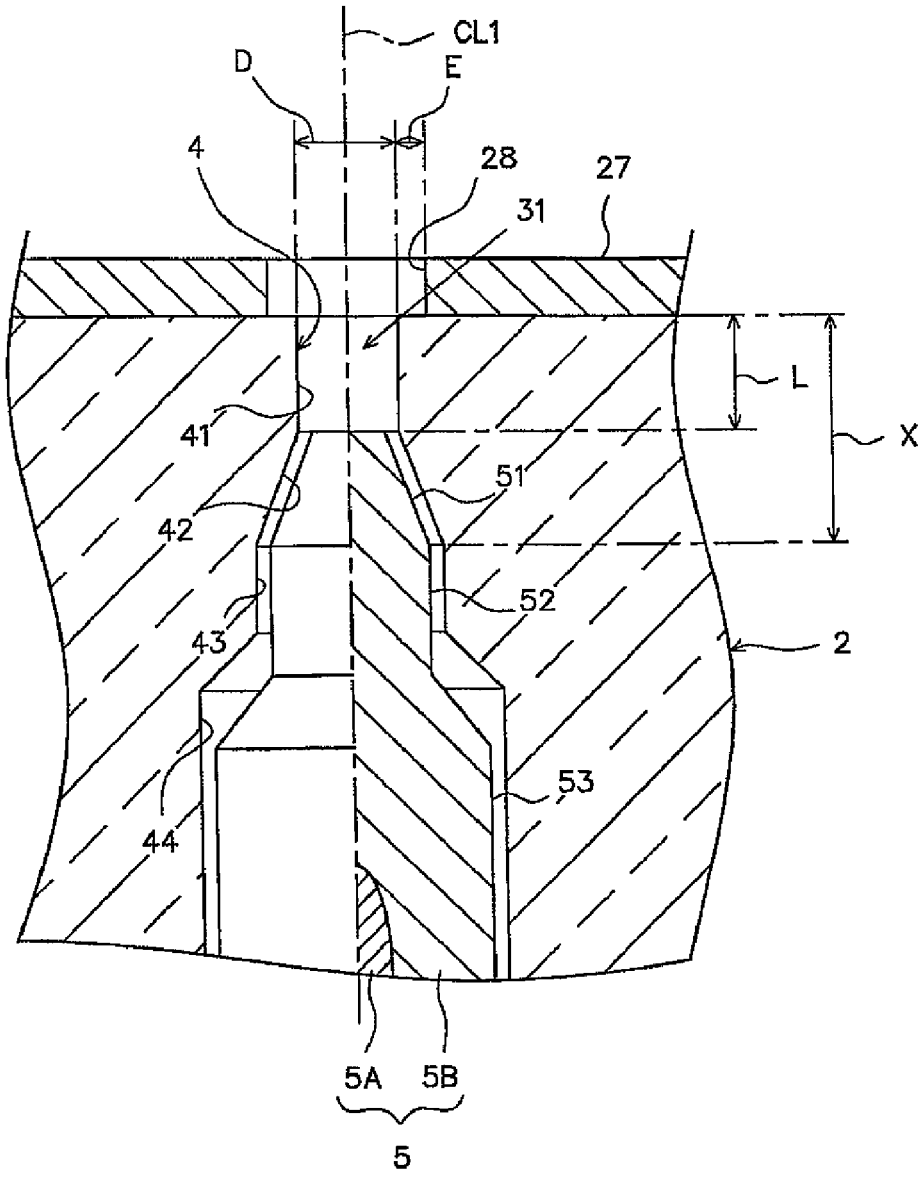
FIG. 2 is a partially-sectioned enlarged front view showing a structure of the front end portion of the plasma jet spark plug.

As shown in FIG. 2, a tapered section 51, a central region 52, and a main body 53 are formed in order in the central electrode 5 from the front end thereof.

Figure 3:
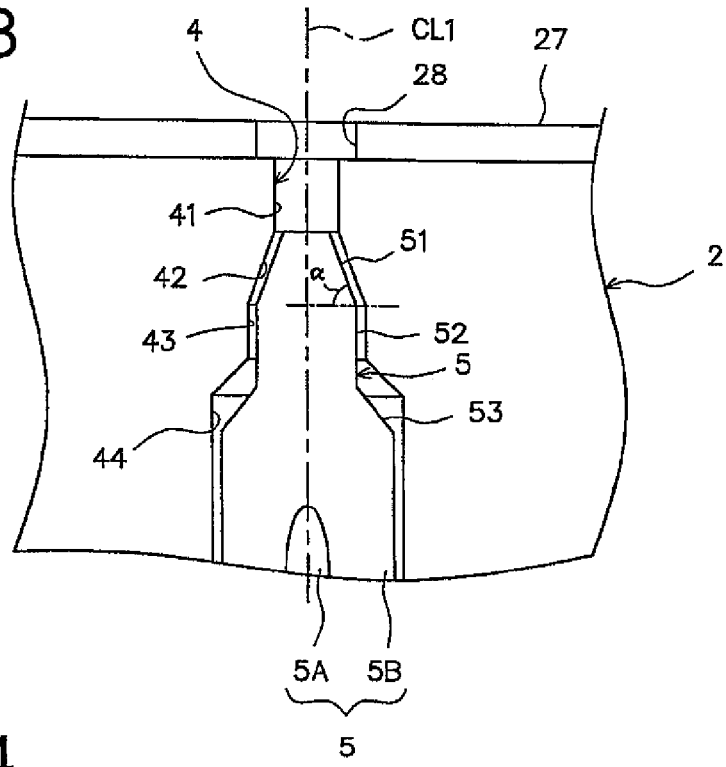
FIG. 3 is a schematic sectional view illustrating a structure of a tapered section of a central electrode.

The tapered section 51 is formed at the foremost end portion of the central electrode 5 and has a reduced diameter toward the front end side in the direction of the axis line CL1 so that the front end surface of the tapered section 51 has a flat shape. Also, the front end surface of the tapered section 51 has a relatively small outer diameter, and the outer diameter is substantially identical to the inner diameter of the axial bore 4 (for example 0.5 mm to 1.2 mm). Meanwhile, the rear end of the tapered section 51 has a slightly large diameter (for example, 0.8 mm to 1.5 mm). Further, as shown in FIG. 3 (hatchings are omitted in FIG. 3 for convenience), in the cross-section including the axis line CL1, an acute angle $\alpha$ (an angle of the tapered section) formed between an external line of the tapered section 51 and a straight line orthogonal to the axis line CL1 is in the range from 30° to 75°. Also, the front end surface of the tapered section 51 is disposed at the same location in the direction of the axis line CL1 with respect to a border between a sidewall section 41 and a diameter-enlarged section 42 of the axial bore 4, described later.

Referring to FIG. 2 again, the middle region 52 has a cylindrical shape extending from the rear end of the tapered section 51 toward the rear end side and has an outer diameter identical to the outer diameter of the rear end of the tapered section 51 (for example, 0.8 mm to 1.5 mm). Also, the length (for example, 1.0 mm to 3.0 mm) of the middle region 52 in the direction of the axis line CL1 is slightly longer than the length (for example, 0.5 mm to 1.5 mm) of the tapered section 51 along the axis line CL1.

The main body 53 extends to the rear end side of central electrodes from the rear end of the middle region 52 and has a tapered shape so that the front end portion of the main body 53 has a reduced diameter toward the front end side in the direction of the axis line CL1. Also, a region of the main body 53 further to rear end side than the tapered portion has a cylindrical shape. A protrusion 54 (see FIG. 1) protruding outwards in the radial direction is formed at the rearmost end portion of the main body 53. In the embodiment shown, the cylindrical portion of the main body 53 has a relatively large outer diameter (for example, 1.6 mm to 2.7 mm), and the inner layer 5A having excellent thermal conductivity is provided. Thus, the heat of the front end portion of the central electrode 5 is efficiently transferred to the rear end side.

The central electrode 5 configured as above is inserted into the front end portion of the axial bore 4 as mentioned above. A sidewall section 41, a diameter-enlarged section 42, a middle region insert region 43, and a main body insert region 44 are formed in the axial bore 4 in order from the front end.

The sidewall section 41 is formed in contact with the opening of the axial bore 4 and forms a cylindrical space extending along the axis line CL1.

In addition, the diameter-enlarged section 42 extends from the rear end of the sidewall section 41 and has a tapered shape having an increased diameter toward the rear end side in the direction of the axis line CL1 along and adjacent the outer peripheral surface of the tapered section 51 of the central electrode 5. In addition, the tapered section 51 of the central electrode 5 is disposed in the diameter-enlarged section 42 while keeping a gap to some extent (for example, 0.01 mm to 0.1 mm). Also, in this embodiment, in the cross-section including the axis line CL1, the external line of the diameter-enlarged section 42 and the external line of the tapered section 51 are parallel with each other.

The middle region insert region 43 forms a cylindrical space extending along the axis line CL1. The front end portion of the middle region 52 is inserted into the middle region insert region 43. In addition, the middle region insert region 43 has an inner diameter slightly larger than the outer diameter of the middle region 52, and the middle region insert region 43 has a length (for example, 0.7 mm to 2.0 mm) along the axis line CL1 that is shorter than the length of the middle region 52 along the axis line CL1.

The main body insert region 44 extends towards the rear end side from the rear end of the middle region insert region 43. The front end portion of the main body insert region 44 has a tapered shape having an increased diameter toward the rear end side in the direction of the axis line CL1. Also, the main body 53 of the central electrode 5 is inserted into the main body insert region 44. Because the length of the middle region insert region 43 in the direction of the axis line CL1 is shorter than the length of the middle region 52 along the axis line CL1 as described above, the front end portion of the main body 53 is spaced apart from the front end portion of the main body insert region 44 along the axis line CL1.

A cavity portion 31 is formed by the inner peripheral surface of the axial bore 4 (the sidewall section 41) and the front end surface of the central electrode 5 (the tapered section 51). Cavity portion 31 opens toward the front end side at the front end side of the axial bore 4. The cavity portion 31 is a cylindrical space, and the length (cavity length) L of the cavity portion 31 in the direction of the axis line CL1 is 0.5 mm to 1.5 mm and the inner diameter (cavity diameter) D of the cavity portion 31 is 0.5 mm to 1.2 mm. Also, with respect to the cavity length L and the cavity diameter D, the formula $L \geqq D$ is satisfied.

The sidewall section 41 forming the cavity portion 31 may be slightly inclined with respect to the axis line CL1 (within ±5°), and the cavity portion 31 may not have a strictly cylindrical shape (for example, the cavity portion 31 may have a sharp tip toward the front end side). In this case, the cavity diameter D represents the average of inner diameters at a plurality of locations of the cavity portion 31 in the direction of the axis line CL1 (for example, a foremost end side or a rearmost end side of the cavity portion 31).

Figure 4:
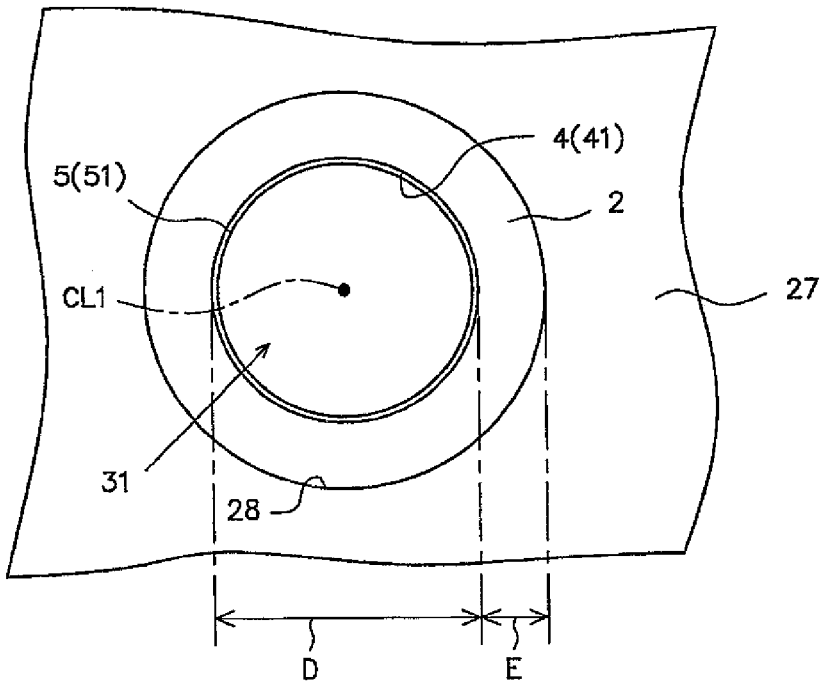
FIG. 4 is a partially enlarged plane view illustrating a distance between a cavity portion and a through hole of a ground electrode.

In addition, in this embodiment, as shown in FIG. 4, the cavity diameter D is smaller than the inner diameter of the through hole 28 of the ground electrode 27, and the ground electrode 27 is not located above the opening of the cavity portion 31. However, with respect to a virtual plane orthogonal to the axis line CL1, in a case where the opening of the cavity portion 31 and the through hole 28 are projected in the direction of the axis line CL1, the shortest distance E between the opening of the cavity portion 31 and the through hole 28, projected as above, is set not to be excessively increased. In this embodiment, the distance E is set to be 0.4 mm or less.

Also, the cavity diameter D or the inner diameter of the through hole 28 may be set so that the ground electrode 27 is located above the opening of the cavity portion 31. However, in this case, the distance E is 0.1 mm or less. In other words, in the virtual plane, on the assumption that, based on the opening of the cavity portion 31, the axis line CL1 side is the − direction and the outer peripheral side is the + direction, the distance E is set to satisfy $-0.1 \leqq E \leqq 0.4$.

In addition, in this embodiment, the distance X (best seen in FIG. 2) from the opening of the cavity portion 31 to the middle region 52 in the direction of the axis line CL1 is less than a predetermined value (for example, 2.0 mm). Thus, when the tapered section 51 disappears due to abrasion, spark discharge is performed between the middle region 52 and the ground electrode 27 to generate plasma. In addition, in this embodiment, the middle region insert region 43 into which the middle region 52 is inserted has a relatively small inner diameter (for example, 1.5 mm). When spark discharge is performed between the middle region 52 and the ground electrode 27, the inner diameter of the cavity portion 31 (after the insulator 2 or the tapered section 51 of the central electrode 5 is consumed) is set not to be excessively increased. For this reason, the ignition quality may be sufficiently maintained even when discharge is performed between the middle region 52 and the ground electrode 27 to generate plasma.

Next, a method for producing the spark plug 1 configured as above is described.

First, the metal shell 3 is processed in advance. In other words, cold forging or the like is performed on a cylindrical metal material (for example, iron-based material or stainless steel material such as S17C and S25C) to produce a general outline while forming a through hole. After that, a cutting process is performed to arrange the appearance, and then the metal shell 3 is obtained.

Subsequently, zinc or nickel is plated to the metal shell 3. Also, in order to improve the corrosion resistance, the surface of the metal shell 3 may be chromate-treated.

The ground electrode 27 is then joined to the front end portion of the plated metal shell 3 by laser welding.

Meanwhile, separately from the metal shell 3, the insulator 2 is produced by molding. For example, material powder containing alumina, as a main component, a binder and so on is used to produce a forming material granule, which is then used to perform rubber press molding, thereby obtaining a cylindrical mold. The obtained mold is ground and smoothed. The smoothed product is then put into a firing furnace and fired. After being fired, the product is polished in various ways to obtain the insulator 2.

Also, separately from the metal shell 3 and the insulator 2, the central electrode 5 is produced. In other words, a forging process is performed on Ni alloy to which copper alloy or the like is disposed at the center portion, in order to improve the radiation of heat, thereby producing a central electrode base material having the tapered section 51 and the middle region 52. Then, an electrode tip is joined to the front end surface of the central electrode base material by welding or the like to make the central electrode 5.

The central electrode 5 and the terminal electrode 6 are sealed and fixed to the insulator 2 by means of the glass seal layer 9. In more detail, after the central electrode 5 is inserted into the front end side of the axial bore 4, glass mixture powder (for example, produced by mixing borosilicate glass and metal powder), which will become the glass seal layer 9 after being fired, is filled in the axial bore 4. The glass mixture powder is then fired and hardened in a firing furnace while pressing the terminal electrode 6 to the front end side from the rear. At this time, a glaze layer may be fired at the same time on the surface of the rear end side chamber 10 of the insulator 2, and a glaze layer may be formed in advance.

Finally, the insulator 2 having the central electrode 5 and the terminal electrode 6 and the metal shell 3 having the ground electrode 27, which are respectively produced as mentioned above, are assembled. In more detail, the spark plug 1 as described above may be obtained by disposing the ring members 24 and 25 and the talc 26 on the large-diameter region 11 of the insulator 2. The opening at the rear end side of the metal shell 3, that is formed with a relatively thin design, is then caulked to the inner side in the radial direction to form the caulking portion 20.

As described above in detail, according to this embodiment, at the initial stages (before the central electrode 5 or the like is consumed), the cavity portion 31 has a cylindrical shape formed by the straight sidewall section 41 extending along the axis line CL1 and the front end surface of the central electrode 5. For this reason, at the initial stages, it is possible to more reliably prevent local concentration of channeling.

The tapered section 51 that is formed at the front end portion of the central electrode 5, has a reduced diameter toward the front end side in the direction of the axis line CL1 and is disposed in the diameter-enlarged section 42 of the insulator 2. A slow increase in the diameter of the front end surface of the central electrode 5 accompanies the consumption. In other words, in accordance with the increase of the inner diameter of the cavity portion 31 which accompanies the consumption of the insulator 2, the diameter of the front end surface of the central electrode 5 is increased. Thus, though the insulator 2 or the central electrode 5 is consumed, the cavity portion 31 may be maintained with a cylindrical shape extending along the axis line CL1 more reliably. As a result, local concentration of channeling may be more reliably prevented not only at the initial stages but also while the insulator 2 or the central electrode 5 is consumed.

If the inner diameter of the cavity portion 31 increases with the consumption of the insulator 2, the jetting length of plasma from the opening of the cavity portion 31 may be decreased, thereby deteriorating the ignition quality. However, in this embodiment, the front end portion of the central electrode 5 is consumed together with the consumption of the insulator 2 so that the length of the cavity portion 31 in the direction of the axis line CL1 is increased. For this reason, the deterioration of ignition quality which accompanies the increase of the inner diameter of the cavity portion 31 may be compensated for, and thus the ignition quality may be improved due to the increase of the length of the cavity portion in the length of the axis line CL1. As a result, even when the insulator 2 or the like is consumed, the ignition quality may be maintained to an extent identical to that in the initial stages.

In addition, according to this embodiment, since the rear end side of the tapered section 51 has a relatively large diameter, the heat at the front end portion of the central electrode 5 may be efficiently removed. For this reason, the rate at which the cavity length increases may be set to be relatively gradual by forming the front end portion into a tapered shape and configuring the central electrode 5 so that a volume per unit length along the axis line CL1 gradually increases from the front end toward the rear end side. As a result, spark discharge may be performed for a longer time between both electrodes 5 and 27. Also, the increase in discharge voltage may be suppressed, so that the consumption of the insulator 2 by channeling may be more reliably suppressed.

According to this embodiment, local concentration of channeling may be effectively prevented, not only at the initial stages but also when the insulator 2 or the like is consumed, so that the ignition quality at the initial stages may be more reliably maintained for a longer time.

Further, since the cavity length L is equal to or larger than the cavity diameter D ($L \geqq D$) and the cavity diameter D is 1.2 mm or less, the expansion of plasma in the radial direction may be suppressed, and thus a jetting speed of plasma in the direction of the axis line CL1 may be increased. As a result, the length of plasma jetting from the opening of the cavity portion 31 may be further increased, so that the ignition quality at the initial stages may be improved.

In addition, the cavity diameter D is set to be 0.5 mm or more. Under a low-temperature environment just after starting, even though a liquefied fuel enters into the cavity portion, the central electrode 5 and the ground electrode 27 are not easily insulated from each other due to the liquefied fuel. In this way, it is possible to improve the starting ability.

Further, since the cavity length L is set to be 1.5 mm or less, the voltage required at the initial stages may be significantly reduced. Thus, even though the required voltage is somewhat increased as a result of the increase in cavity length that accompanies the consumption of the central electrode 5, problems, such as a misfire, do not easily occur as before. As a result, spark discharge may be generated for a longer time in a more reliable way.

In addition, as for the distance E, $E \geqq -0.1$, and relative to the opening of the cavity portion 31, a region covered by the ground electrode 27 is extremely small. Thus, the jetting of plasma from the cavity portion 31 is not easily disturbed by the ground electrode 27, and the removal of the heat of the plasma through the ground electrode 27 may be more reliably prevented. As a result, the ignition quality may be further improved.

Meanwhile, as for the distance E, $E \leqq 0.4$, and the shortest distance from the opening of the cavity portion 31 to the through hole 28 of the ground electrode 27 is set to be relatively decreased. Thus, when spark discharge is generated, aerial discharge may be easily generated between the opening of the cavity portion 31 and the ground electrode 27, so that a discharge in the shape of the angled region between the axial bore 4 and the front end surface of the insulator 2 may be not easily generated. As a result, local concentration of channeling may be more reliably prevented, so that the ignition quality at the initial stages may be maintained for a longer time.

Also, in the cross-section including the axis line CL1, since the angle α of the tapered section is established to be 30° or above, the rate of enlargement of the diameter of the front end surface of the central electrode 5, which enlargement accompanies the consumption, may be set to be relatively small. In this way, the front end surface of the central electrode 5 slowly increases in relation to an increase rate of the cavity diameter, which increase accompanies the consumption of the insulator 2. As a result, the cavity portion 31 may be maintained in a cylindrical shape more reliably, and the concentration of channeling according to the above configuration may be more reliably suppressed.

In the cross-section including the axis line CL1, the angle α of the tapered section is set to be 75° or less, and the distance between the region (the middle region 52) extending to the rear end side from the rear end of the tapered section 51 and the front end of the tapered section 51 is set so as not to be excessively increased. For this reason, the heat at the front end portion of the tapered section 51 may be more reliably removed, so that the abrasion resistance of the central electrode 5 may be improved. As a result, the speed at which the cavity length increases may be set to be gradual, and further the time during which ignition is possible may be further lengthened.

In this embodiment, in a state that the central electrode 5 is inserted into the axial bore 4, the front end portion of the main body 53 is spaced apart from the front end portion of the main body insert portion 44 along the axis line CL1. Thus, when the central electrode 5 is disposed in the axial bore 4, it is possible to prevent the main body 53 of the central electrode 5 from contacting the axial bore 4. In this way, in the event there is a minor measurement error in the central electrode 5, it is possible to more reliably prevent the insulator 2 from being damaged.

Next, in order to check the operation effects realized by this embodiment, a plurality of spark plug samples having various lengths L (cavity length) of the cavity portion along the axis line and various inner diameters (cavity diameter) D of the cavity portion were produced. An ignition quality evaluation test, a start ability evaluation test, and an initial discharge voltage measurement test were then performed for each sample.

The outline of the ignition quality evaluation test is as follows. In other words, each sample was attached to a four-cylinder engine with a displacement of 1.5 L, and then the engine was operated at 1,600 rpm with an intake pressure of −320 mmHg. In addition, while increasing the air-fuel ratio (diluting the fuel), a variation of engine torque was measured at each air-fuel ratio, and then the air-fuel ratio when the variation of engine torque exceeds 5% is defined as the ignition limit air-fuel ratio. Also, a greater air-fuel ratio means superior ignition quality at the initial stages.

The outline of the start ability evaluation test is as follows. Samples having various cavity diameters D were attached to a four-cylinder engine with a displacement of 1.5 L, and then the engine was operated at a water temperature of 0° C. The waveform of the discharge voltage (discharge waveform) was measured for 1 minute after the engine started, and then, based on the discharge voltage, the number of misfires occurring during 1 minute was measured. Here, for four or more misfires occurring in 1 minute, the sample was evaluated to have a deteriorated start ability and then graded as "X." For one to three misfires occurring in one minute, the sample was evaluated to have a slightly deteriorated start ability and then graded as "Δ". If no misfires occurred for 1 minute, the sample was evaluated to have an excellent start ability and graded as "○". Each sample was tested five times.

The outline of the initial discharge measurement test is as follows. Samples having various cavity lengths L were attached to a chamber for the testing, and then spark discharge was performed several times in the chamber for which the pressure was set to 0.8 MPa. Along with measuring the discharge voltage of each spark discharge, the average value of discharge voltages (an average discharge voltage) was calculated for each sample. Considering that the discharge voltage is slowly increased due to the consumption of the central electrode and channeling is more easily generated at the insulator as the discharge voltage becomes greater, the average discharge voltage representing the discharge voltage before the central electrode is consumed (an initial discharge voltage) was preferably set to 15 kV or less.

Figure 5:
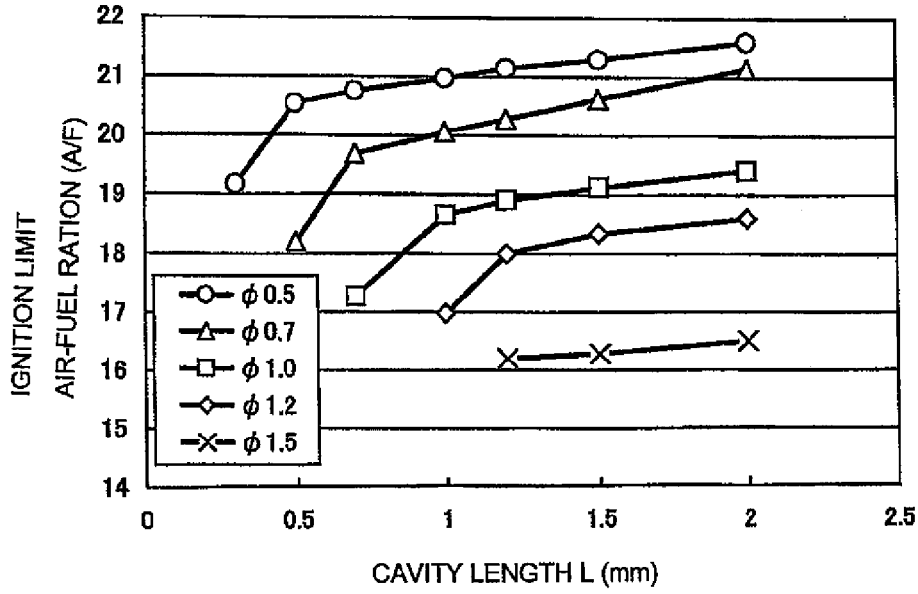
FIG. 5 is a graph showing test results of an ignition quality evaluation test for samples having various cavity lengths and cavity diameters.
Figure 6:
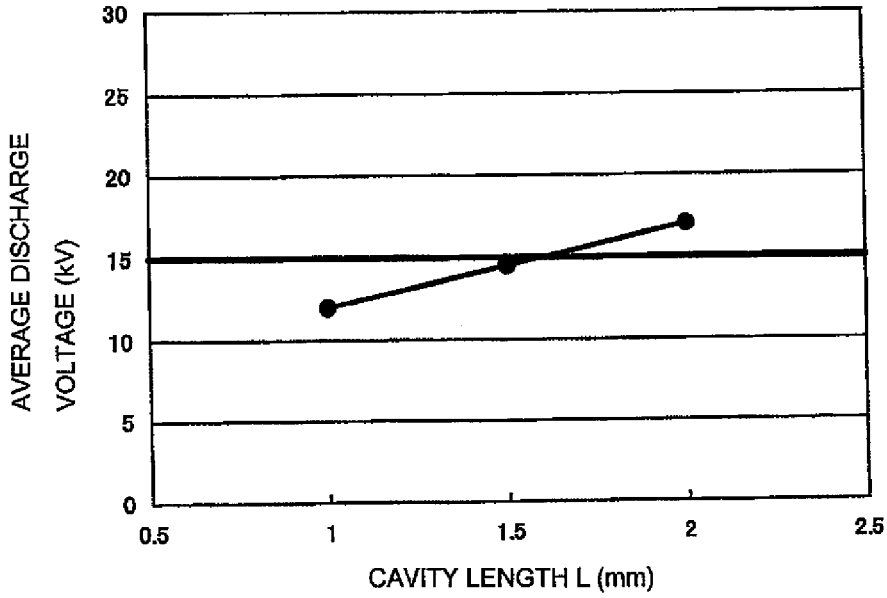
FIG. 6 is a graph showing results of an initial discharge voltage measurement test for samples having various cavity lengths.

FIG. 5 shows results of the ignition quality evaluation test. Table 1 shows the results of the start ability evaluation test. FIG. 6 shows the results of the initial discharge voltage measurement test. In FIG. 5, the test results of a sample having a cavity diameter D of 0.5 mm are plotted with ○ (circle marks), the test results of a sample having a cavity diameter D of 0.7 mm are plotted with Δ (triangle marks), the test result of a sample having a cavity diameter D of 1.0 mm is plotted with □ (square marks), the test results of a sample having a cavity diameter D of 1.2 mm are plotted with ◇ (diamond marks), and the test results having a cavity diameter D of 1.5 mm are plotted with X (X marks).

TABLE 1

| | Cavity diameter D (mm) | | | | | | | | | | | | | | |
|---|---|---|---|---|---|---|---|---|---|---|---|---|---|---|---|
| | 0.3 | | | | | 0.5 | | | | | 1.0 | | | | |
| Evaluation | X | Δ | X | X | Δ | ○ | ○ | ○ | ○ | ○ | ○ | ○ | ○ | ○ | ○ |

As shown in FIG. 5, it was obvious that the initial ignition quality is deteriorated if the cavity length L is smaller than the cavity diameter D (in other words, a sample of L<D). It is believed that the plasma spreads easily in the radial direction because the cavity diameter D is larger than the cavity length L, which causes the deterioration of the jetting speed of plasma in the direction of the axis line and further the decrease in the jetting length of plasma from the cavity.

In addition, it was revealed that, even if a sample satisfies L≧D, if the cavity diameter D is set to 1.5 mm, the initial ignition quality is deteriorated regardless of the cavity length L because the ignition limit air-fuel ratio is relatively decreased. It is believed that the plasma spreads in the radial direction due to the relatively large cavity diameter, and thus the jetting length of plasma is shortened.

Meanwhile, it was confirmed that a sample having a cavity length of 1.2 mm or less and in which the cavity length L was equal to or greater than the cavity diameter D (namely, L≧D) has excellent ignition quality.

Further, as shown in the Table 1, it was found that a sample having a cavity diameter D less than 0.5 mm easily causes misfires and has deteriorated start ability. It is believed that the jetted fuel gas is easily liquefied under a low-temperature environment just after starting, and thus the central electrode and the ground electrode are easily insulated due to the liquefied fuel when the liquefied fuel enters into the cavity portion due to the excessively small cavity diameter D.

Meanwhile, it was apparent that a sample having a cavity diameter D of 0.5 mm or more has an excellent start ability without causing a misfire even under a low-temperature environment just after starting.

As shown in FIG. 6, it was found that a sample having a cavity length L of 1.5 mm or less may have an initial discharge voltage of 15 kV or less, and thus this sample effectively prevents the occurrence of misfire or the progress of channeling.

From the viewpoint of realizing excellent ignition quality and excellent start ability in synthetic consideration of the above test results, it is preferred that (A) the cavity length L is equal to or greater than the cavity diameter D ($L \geqq D$), (B) the cavity diameter D is 0.5 mm to 1.2 mm, and (C) the cavity length L is 1.5 mm or less. Also, the cavity length L is set to 0.5 mm or more from the conditions (A) and (B).

Subsequently, by changing the inner diameter of the through hole of the ground electrode in various ways, there were produced spark plug samples having various shortest distances E (mm) between the opening of the cavity portion and the through hole of the ground electrode. During the tests, the opening of the cavity portion, the axial side is considered the − direction and the outer peripheral side is considered the + direction, when viewing the opening of the cavity portion and the through hole of the ground electrode projected to a virtual plane orthogonal to the axis line. The ignition quality evaluation test and the ignition quality maintenance time evaluation test were then performed for each sample.

The outline of the ignition quality maintenance time evaluation test is as follows. Samples were attached to a predetermined chamber, the pressure in the chamber was set to 0.4 MPa, the frequency of the applied voltage was set to 60 Hz (so that 3,600 discharges occurred per minute) to discharge each sample, and then channeling was generated at the inner peripheral surface of the cavity portion. The samples were detached from the chamber at each of predetermined measurement times. The above ignition quality evaluation test was performed for the detached sample, and the ignition limit air-fuel ratio was measured at each measurement time. When the measured ignition limit air-fuel ratio was deteriorated by 10% or more of the average value of previous ignition limit air-fuel ratios, the measurement time just before the above measurement was defined as the time (maintenance time) during which the ignition quality of the initial stages could be maintained. For example, assuming that the ignition limit air-fuel ratio of the sample was measured at every 50 hours and the ignition limit air-fuel ratio of the sample when 750 hours pass is deteriorated by 10% or more of the average value of previous ignition limit air-fuel ratios, the maintenance time becomes 700 hours. Also, this test was measured while not substantially consuming the central electrode by just generating spark discharge without a current for generating plasma flowing.

Figure 7:
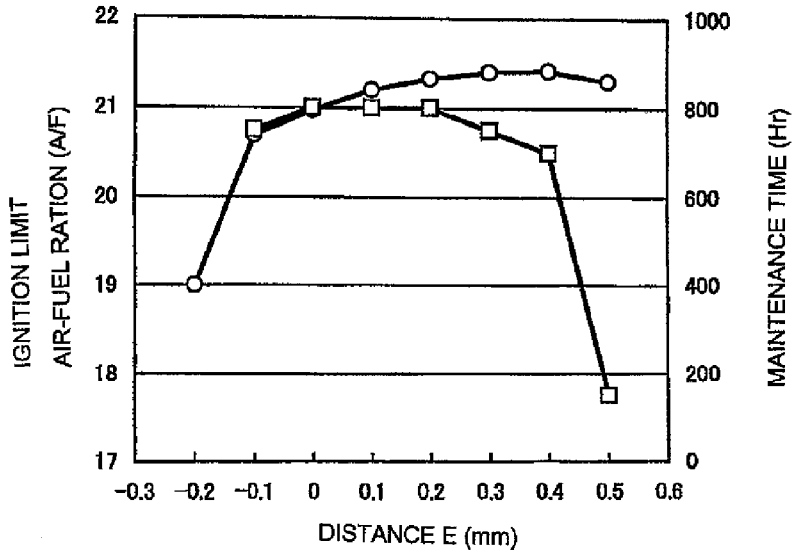
FIG. 7 is a graph showing test results of an ignition quality evaluation test and an ignition quality maintenance time evaluation test, for samples having various distances E.

FIG. 7 shows the results of the ignition quality evaluation test and the ignition quality maintenance time evaluation test for the samples with various distances E. In FIG. 7, the results of the ignition quality evaluation test are plotted with circle marks (○), and the results of the ignition quality maintenance time evaluation time test are plotted with square marks (□). Also, in each sample, the cavity length L was 0.5 mm, and the cavity diameter D was 1.0 mm.

As shown in FIG. 7, the sample having a distance E less than −0.1 mm has an ignition limit air-fuel ratio lower than 20.0, and thus it is found that the ignition quality of this sample at the initial state is slightly deteriorated. It is believed that plasma may be not easily jetted out or the heat of plasma may be easily removed by the ground electrode since a relatively wide range of the opening of the cavity portion is covered by the ground electrode.

Also, it is apparent that the sample having a distance E of +0.4 mm has excellent ignition quality at the initial stages, but the time during which the ignition quality at the initial stages can be maintained is relatively shortened. It is believed that discharge easily occurs in the shape of the angled region between the axial bore and the front end surface of the insulator when spark discharge occurs, and thus the angled region is worn thin and further channeling may be easily locally concentrated.

On the contrary, it was found that the sample having a distance E of $-0.1 \leqq E \leqq E+0.4$ has excellent ignition quality at the initial stages, and this excellent ignition quality may be maintained for a long time.

Subsequently, samples having various acute angles (angles of the tapered section) $\alpha$ formed between the external line of the tapered section and the straight line orthogonal to the axis line in the cross-section including the axis line were produced by varying the inclination angle of the tapered section of the central electrode. The ignition quality maintenance time evaluation test and the abrasion resistance evaluation test were then performed for each sample.

The outline of the abrasion resistance evaluation test is as follows. Samples were attached to a predetermined chamber, the pressure in the chamber was set to 0.4 MPa, the frequency of the applied voltage was set to 60 Hz to discharge each sample, and current flows thereto from a plasma power source with an output of 120 mJ to generate plasma. The volume (a consumed volume ratio) of the central electrode consumed per hour was measured for each sample.

In the ignition quality maintenance time evaluation test, the front end of the central electrode of every sample was worn thin by 3 mm, and a bent portion formed from sidewall sections and a diameter-enlarged section is provided at the inner peripheral surface of the cavity portion so that the channeling may be easily concentrated. In each sample, the outer diameter of the front end surface of the tapered section was 0.5 mm, and the outer diameter of the rear end of the tapered section was 1.5 mm.

Figure 8:
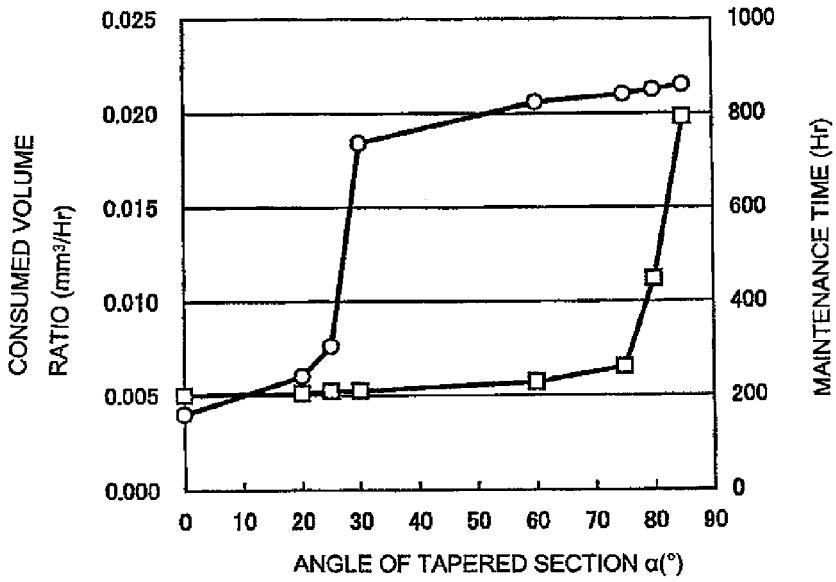
FIG. 8 is a graph showing test results of an ignition quality maintenance time evaluation test and test results of an abrasion resistance evaluation test, for samples having various angles in the tapered section.

FIG. 8 shows the results of the ignition quality maintenance time evaluation test and the abrasion resistance evaluation test for samples having various angles $\alpha$ of the tapered section. in FIG. 8, the test results of the ignition quality maintenance time evaluation test are plotted with circle marks (○), and the test results of the abrasion resistance evaluation test are plotted with square marks (□).

As shown in FIG. 8, it was found that, in the sample having an angle $\alpha$ of the tapered section less than 30°, the time during which the ignition quality at the initial stages can be maintained is relatively shortened. It is believed that the bent portion is continuously present in the cavity portion since the central electrode is consumed rather than the consumption of the insulator, and as a result, channeling caused by the bent portion may be easily concentrated.

Also, it is apparent that, in the sample having an angle $\alpha$ of the tapered section greater than 75°, the central electrode is rapidly consumed. It is believed that the distance between the region (corresponding to the "middle region" in this embodiment) extending to the rear end side from the rear end of the tapered section of the central electrode and the front end of the tapered section is elongated since the angle α of the tapered section is set to be great, and as a result, the heat at the front end portion of the tapered section is not sufficiently removed.

On the contrary, it was found that, in the sample having an angle α of the tapered section from 30° to 75°, the time during which the ignition quality at the initial stages can be maintained is long, and also the central electrode is hardly consumed.

From the viewpoint of further improving the ignition quality at the initial stages in consideration of the results of each test as above, it would be more preferred that the distance E is −0.1 mm or more.

Further, from the viewpoint that the ignition quality at the initial stages is maintained for a longer time, it would be more preferred that the distance E is +0.4 mm or less, or the angle α of the tapered section is 30° or more.

In addition, from the viewpoint that the consumption of the central electrode is suppressed and the time during which ignition is possible is lengthened, the angle α of the tapered section is preferably 75° or less.

Also, the invention is not limited to the above embodiment, and the following embodiments are also available for examples. Other applications and modifications are also possible, even though not illustrated below.

Figure 9:
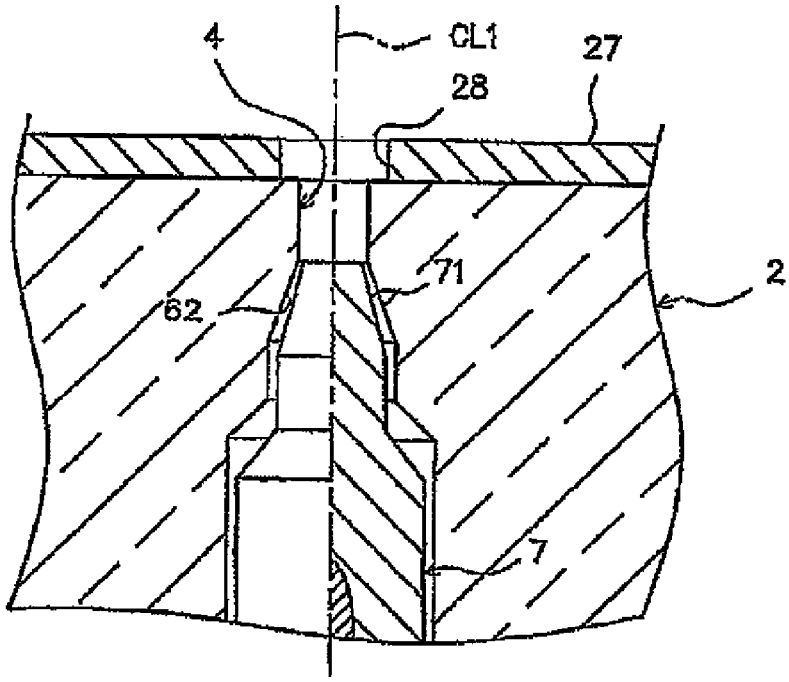
FIG. 9 is a partially-sectioned enlarged front view showing a structure of a tapered section and a diameter-enlarged section according to another embodiment.

(a) In the above embodiment, in the cross-section including the axis line CL1, the external line of the tapered section 51 is set to be parallel with the external line of the diameter-enlarged section 42, but both external lines are not limited to a strictly parallel arrangement. Thus, as shown in FIG. 9, in the cross-section including the axis line CL1, a tapered section 71 or a diameter-enlarged section 62 may be configured so that an acute angle between the external line of the tapered section 71 and the axis line CL1 is smaller than an acute angle between the external line of the diameter-enlarged section 62 and the axis line CL1. In this case, in the event that there is a minor measurement error in the central electrode 7, in a manufacturing process, the rear end portion of the tapered section 71 hardly come into contact with the diameter-enlarged section 62, and thus it is possible to more reliably prevent the insulator from being damaged. In this way, it is possible to improve the yield. Further, since the distance between the outer edge of the front end surface of the tapered section 71 and the axial bore 4 may be set to be smaller, the voltage required for aerial discharge between the front end surface of the tapered section 71 and the axial bore 4 may be reduced. Thus, the discharge voltage at the initial stages may be reduced, and thus the channeling may be more reliably suppressed.

Figure 10:
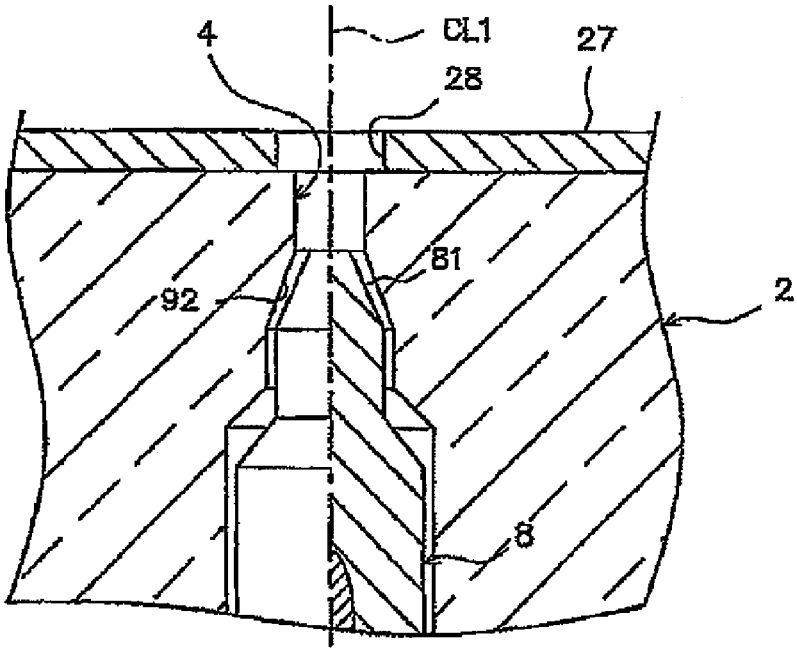
FIG. 10 is a partially-sectioned enlarged front view showing a structure of a tapered section and a diameter-enlarged section according to another embodiment.

Also, as shown in FIG. 10, in the cross-section including the axis line CL1, a tapered section 81 or a diameter-enlarged section 92 may be configured so that an acute angle between the external line of the tapered section 81 and the axis line CL1 is greater than an acute angle between the external line of the diameter-enlarged section 92 and the axis line CL1. In this case, the distance between the outer edge of the front end surface of the central electrode 8 and the axis hole 4 is slowly decreased accompanied with the consumption of the central electrode 8. Thus, the increase of discharge voltage may be suppressed when the central electrode 8 is consumed.

In addition, the difference in angles between the angle formed by the external line of the tapered section 71 (81) and the axis line CL1 and the angle formed by the external line of the diameter-enlarged section 62 (92) and the axis line CL1 is preferably 15° or less.

Figure 11:
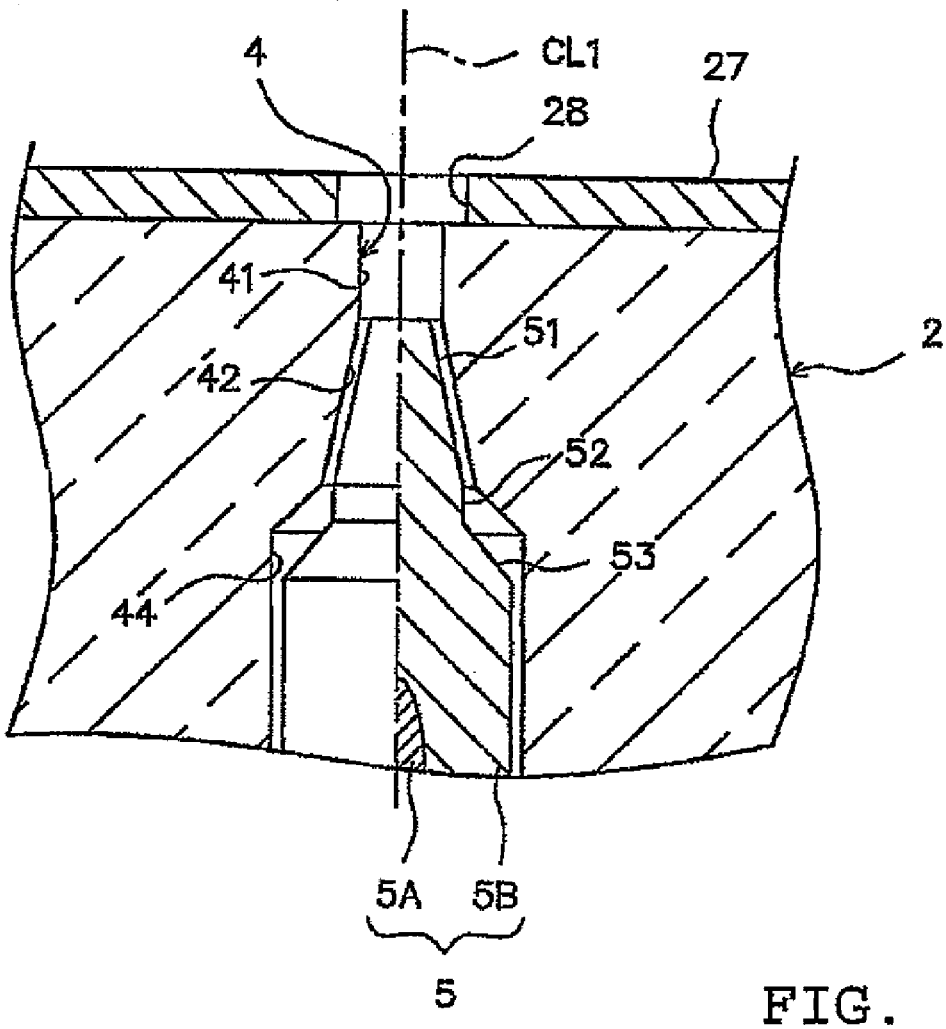
FIG. 11 is a partially-sectioned enlarged front view showing a structure of an axial bore according to another embodiment.

(b) In the above embodiment, the middle region insert region 43 into which the middle region 52 of the central electrode 5 is inserted is formed at the axial bore 4, but as shown in FIG. 11, the axial bore may be configured without forming the middle region insert region 43.

(c) In the above embodiment, the ground electrode 27 is surface-contacted with the front end surface of the insulator 2, but it is also possible for a small gap to exist between the front end surface of the insulator 2 and the ground electrode 27.

(d) In the above embodiment, the through hole 28 is located coaxially with the axial bore 4 (the center of the through hole 28 is located on the axis line CL1), but the center of the through hole 28 may slightly deviate from the axis line CL1.

(e) In the above embodiment, the tool engagement portion 19 has a hexagonal cross-section, but the shape of the tool engagement portion 19 is not limited thereto. For example, the tool engagement portion 19 may have a Bi-HEX (modified dodecagonal) shape [IS022977: 2005(E)].

Having described the invention, the following is claimed:

1. A plasma jet spark plug, comprising:

a cylindrical insulator having a front end, a rear end and an axial bore extending therethrough in an axial direction;

a rod-shaped central electrode inserted into the axial bore so that a front end surface of the central electrode is located further to a rear end side in the axial direction than the front end of the insulator;

a cylindrical metal shell disposed around an outer peripheral surface of the insulator;

a ground electrode installed at a front end portion of the metal shell; and a cavity portion that is a substantially cylindrical space formed by the inner peripheral surface of the axial bore and the front end surface of the central electrode and opened toward a front end side of the plasma jet spark plug, wherein a tapered section having a reduced diameter toward a front end side in the axial direction is formed at a front end portion of the central electrode, and wherein the axial bore includes:

a sidewall section forming the cavity portion; and a diameter-enlarged section extending from a rear end of the sidewall section and formed at a location corresponding to the tapered section of the central electrode in the axial direction, the diameter-enlarged section having an enlarged diameter toward a rear end side in the axial direction along an outer peripheral surface of the tapered section of the central electrode.

2. The plasma jet spark plug as claimed in claim 1, wherein, the following formulas (1) to (3) are satisfied:

$$L \geqq D \quad (1)$$

$$0.5 \leqq L \leqq 1.5 \quad (2)$$

$$0.5 \leqq D \leqq 1.2 \quad (3),$$

where L (mm) is a length of the cavity portion in the axial direction, where D (mm) is an inner diameter of the cavity portion.

3. The plasma jet spark plug as claimed in claim 1, wherein the ground electrode having a plate shape has a through hole that is formed through the ground electrode in a thickness direction thereof, and wherein, the following formula is satisfied:

$$-0.1 \leqq E \leqq 0.4$$

where the shortest distance E (mm) between an opening of the cavity and the through hole of the ground electrode when projected to a virtual plane orthogonal to an axis line, where – direction is defined as the axial side with reference to the opening of the cavity portion, where + direction is defined as the outer peripheral side with reference to the opening of the cavity portion.

4. The plasma jet spark plug as claimed in claim 1, wherein, in a cross-section including the axis line, an acute angle formed between an external line of the tapered section of the central electrode and a straight line orthogonal to the axis line is in the range from 30° to 75°.

5. The plasma jet spark plug as claimed in claim 1, wherein the central electrode has a main body provided at a rear end side of the tapered section and having an outer diameter larger than that of the rear end of the tapered section, wherein the axial bore has a main body insert portion formed at the rear end side of the diameter-enlarged section and having an inner diameter larger than that of the rear end of the diameter-enlarged section, so that the main body is inserted into the main body insert portion, and wherein, in a state that the central electrode is inserted into the axial bore, the front end portion of the main body is spaced apart from the front end portion of the main body insert portion in the axial direction.

* * * * *